United States Patent [19]

Case

[11] 4,235,550

[45] Nov. 25, 1980

[54] AUTOMATIC DOCUMENT HANDLER CONTROL

[75] Inventor: Raymond D. Case, Fairport, N.Y.

[73] Assignee: Xerox Corporation, Stamford, Conn.

[21] Appl. No.: 40,334

[22] Filed: May 18, 1979

[51] Int. Cl.[3] ..... G03G 15/00

[52] U.S. Cl. ..... 355/14 R; 355/14 SH

[58] Field of Search ..... 355/3 R, 3 SH, 14 R, 355/14 SH

[56] References Cited

U.S. PATENT DOCUMENTS 3,674,363 7/1972 Baller et al. ..... 355/14 R 4,043,550 8/1977 Phillips et al. ..... 355/75 X 4,093,372 6/1978 Guenther ..... 355/50

*Primary Examiner*—Fred L. Braun

[57] ABSTRACT

A reproduction machine having a removable automatic document handler for circulating documents to be copied onto the platen of the reproduction machine. Control members independent from the control circuits of the reproduction machine are provided for the automatic document handler to cycle the reproduction machine and the automatic document handler in response to the illumination produced during exposure of the documents on the platen.

4 Claims, 2 Drawing Figures

AUTOMATIC DOCUMENT HANDLER CONTROL

BACKGROUND OF THE INVENTION

With the introduction of xerographic reproduction machines which have greatly increased the efficiency of modern offices, a problem was perceived in the extensive amount of time required for the machine operator to feed original documents to the platen of the reproduction machine to be copied. This is particularly true where documents containing a large number of pages are to be reproduced. In response to this problem, automatic document handlers have been provided to automatically feed the pages of the document being copied to the exposure platen of the machine and to return the exposed documents to a suitable location. These doucment handlers are ordinarily provided on large, high output, fully featured, reproduction machines. However, in many instances it may be desirable to provide a simple, inexpensive document handler for use with the more inexpensive reproduction machines. In the past, the interconnection between the automatic document handler and the reproduction machine has required extensive rewiring of the systems and in many instances, completely new reproduction machine control logic.

SUMMARY OF THE INVENTION

A control system for an automatic document handler to enable use of the document handler on a copy reproduction machine without requiring electrical interconnection between the reproduction machine and the document handler, the control system being selectively responsive to the exposure illumination of the reproduction machine to maintain each page of a document being copied on the platen of the machine to produce the required number of copies of each page and to energize the document handler to automatically feed successive pages to the platen of the machine to thereby produce the required number of copies of each page of the document.

DESCRIPTION OF THE PREFERRED EMBODIMENT

Figure 1:
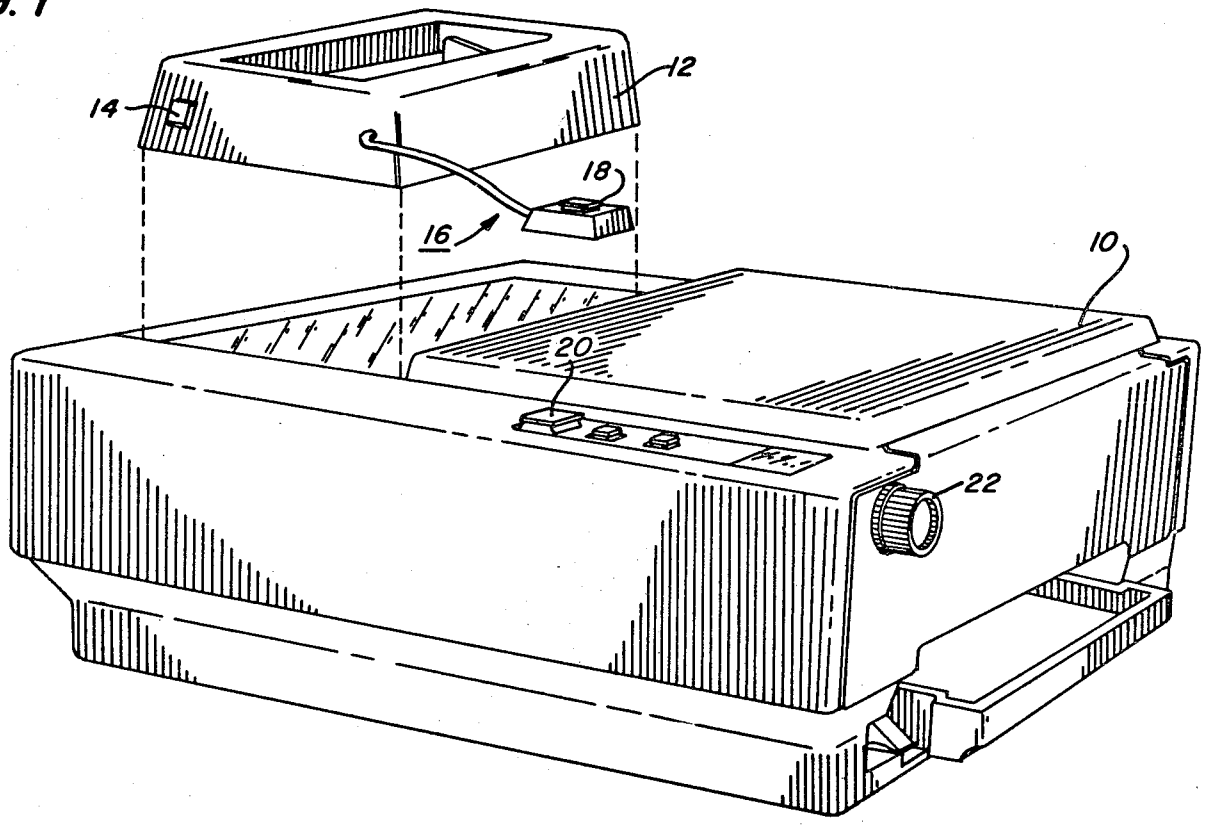
FIG. 1 illustrates a copy reproduction machine having a removable automatic document handler thereon; and, FIG. 2 is a control schematic for operating the automatic document handler and energizing the reproduction machine to produce the required number of copies of each page of the document in a copy run.

Referring to FIG. 1, there is illustrated a xerographic reproduction machine 10 of the type fully explained and disclosed in U.S Pat. Nos. 3,831,933 and 3,900,258, which patents are expressly incorporated herein by reference. Since the reproduction machine per se is ancillary to the subject invention, it is not deemed necessary to explain in detail the xerographic process employed to reproduce copies of documents presented thereto.

Further the control circuits or logic utilized to operate the xerographic processor and sequence the various xerographic steps such as sheet feeding, exposure, transfer, etc., which controls are described in the aforementioned patents do not constitute any part of the subject invention since the control to be hereinafter described is adapted for use with any reproduction machine without electrical interconnection to the reproduction machine logic or control systems.

FIG. 1 also illustrates an automatic document handler 12 which is adapted for placement on or removal from the platen of a manually operated reroduction machine. U.S. Pat. Nos. 3,674,363 and 4,043,550 which are expressly incorporated herein by reference are illustrative of document handlers which, along with their internal controls, could be adapted for physical placement on or removal from the platen of a manual document placement reproduction machine. It should be understood that the document handler could be of the recirculating type wherein the documents are returned to the feed tray following copying, suitable bail bars or separator means being provided in the document tray to separate documents to be copied from those already copied. In the alternative, the automatic document handler could be of the type wherein after the documents have been copied, means are provided to feed the documents into an output tray or onto a top surface of the reproduction machine.

Figure 2:
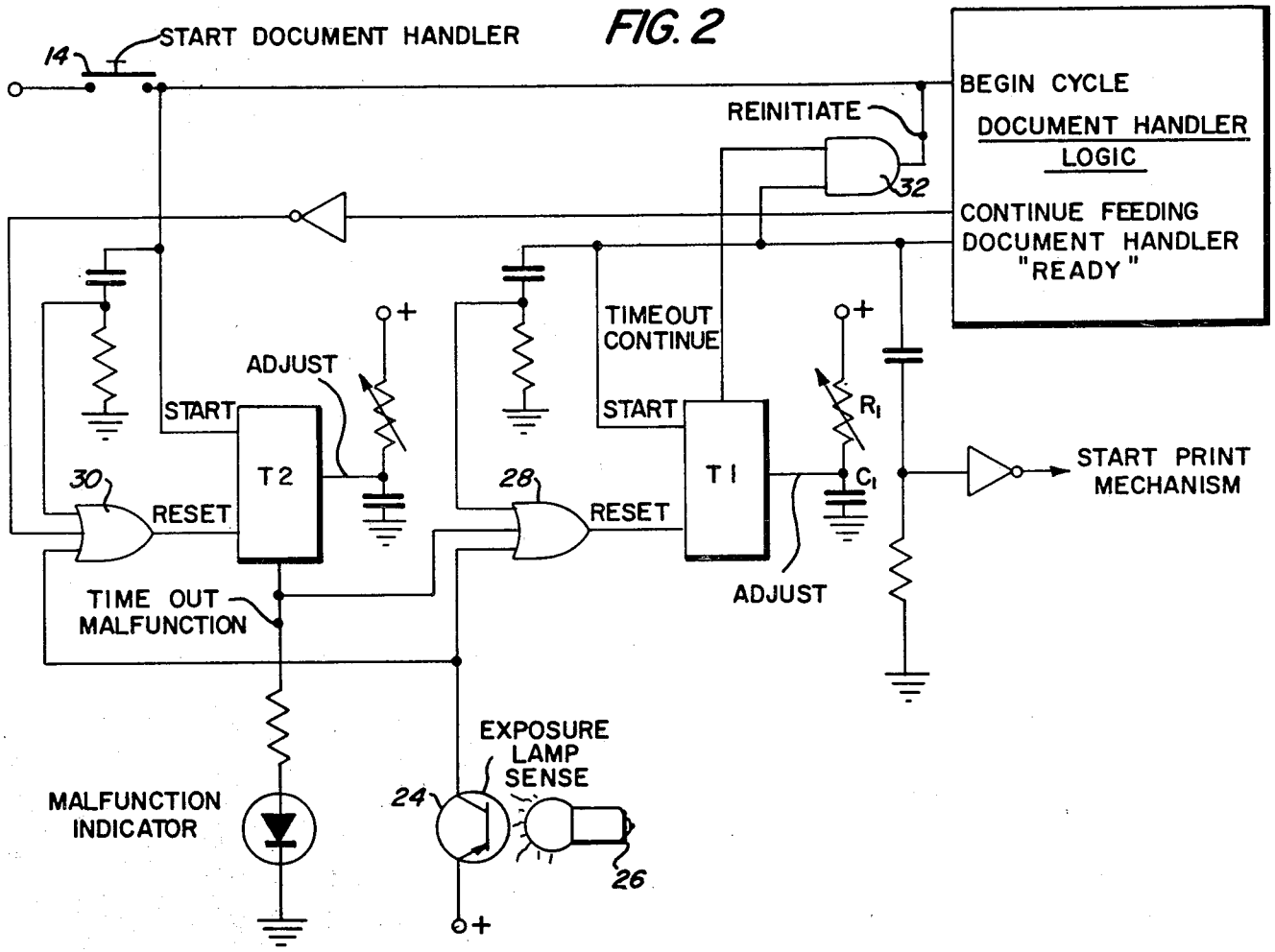

Referring to FIG. 2, there is illustrated an exemplary interface control circuit for use with the normal controls of an automatic document handler to enable the removable document handler to be operated in response to the exposure illumination of the reproduction machine and thereby obviate the need for electrical interconnection between the reproduction machine and the document handler. The illustrated control circuit is adapted to be wired into the normal document handler control logic circuitry which is adapted to operate the document handler per se. This document handler control circuitry ordinarily includes a sequencer adapted to energize the document sheet separator, the various feed rolls and belts within the document handler, and movement of registration fingers or edges into and out of the path of the fed sheets. Various sheet sensors are also provided to detect the presence of sheets in the document feed tray, on the platen for copying or being fed out of the machine, or to detect sheet jams within the document handler.

The interface control circuit is interconnected at 3 points of the document handler control circuit i.e., "begin cycle", "continue feeding", (connected to the portion of the document handler control which senses presence of documents in the document tray to be fed), and "document handler ready" (interconnected to the sheet sensor adapted to sense presence of a document in the copying position within the document handler). The illustrated interface control system also incorporates a start document handler button 14 to initiate operation of the combined document handler reproduction machine and a suitable start print mechanism 16. The start print mechanism 16 is illustrated in FIG. 1 as an umbilical cord device having an electromechanical actuator 8 such as a solenoid on the end thereof adapted for placement over the start print button 20 of the reproduction machine to mechanically press the start print button 20 upon receipt of a signal from the control system of FIG. 2. This electromechanical device could be adapted for mounting on the reproduction machine by magnetic means, sticky tape, self-tapping screws, etc.

Considering the operation of the reproduction system including the reproduction machine 10 and the automatic document handler 12, after placing the document to be copied in the document handler, the operator dials the desired number of copies of each page of the document on the copy counter 22 of the reproduction machine. Copying is thereafter initiated by the operator pressing the start document handler button 14 on the document handler. By pressing the start button, a momentary positive pulse is provided to the document handler logic through the "begin cycle" input and the document handler presents the first page of the document therein to the platen of the reproduction machine. When the page is in place on the platen, the sheet sensor "document handler ready" sends a ready pulse or signal to the interface control logic which initiates or energizes the start print mechanism 16 to press the start print button 20 on the reproduction machine and at the same time, triggers timer T1 to start timeout. Timer T1 may be any suitable timer such as a "SIGNETICS" Model 555 timer IC, the time period of which can be adjusted by a suitable external RC circuit. Timer T1 is preset or adjusted through the adjustable resistor capacitor circuit RC for a time period longer than the cycle time of the copier, e.g., the time between start print and illumination of the document for producing a copy. Timer T1 is reset by a signal initiated by phototransistor 24 positioned in the document handler at a location to sense the energization of the flash or exposure lamp 26 in the reproduction machine signifying that an exposure of the document page on the platen has been made by the reproduction machine as part of the copy cycle. The signal from the phototransistor resets timer T1 through an OR gate 28 and at the same time pulses a timer T2 through an OR gate 30. If energization of the exposure lamp 26 is not sensed in the pre-set time period of timer T1, timer T1 will time out. If an enabling or continue signal is still present at this point, the feeder control logic will reinitiate the start feeder sequence with preset number of copies of the page on the platen, the feeder will not be actuated to feed another page thereto. The aforementioned sequence will continue until the enabling (continue) signal is no longer present, signifying that there are no more originals left to be copied, at which point a signal will not be provided through AND gate 32, the feeder will no longer be energized to feed another document, and the system will shut down.

Timer T2, which may be the same type of timer as T1, is provided to monitor the time from the initiation of or reinitiation of the feed cycle to the time of illumination to determine if a system malfunction has occurred. If illumination is not sensed within the preselected time period of timer T2 from initiate or reinitiate, this signifies that the reproduction machine is inoperative for reasons such as out of paper, jam, etc., and the system will shut down.

From the foregoing it can be seen that a simple circuit is provided which enables the operation of a reproduction machine and a removable automatic document handler without requiring electrical interconnection between the document handler and the reproduction machine. However, it should be understood that the electrical circuit of FIG. 2 is illustrative only, in that other circuits which would accomplish the same end could be utilized to allow operation of an automatic document handler in response to the exposure illumination of a reproduction machine.

While I have described a preferred embodiment of my invention, it is to be understood that the invention is not limited thereto but may be otherwise embodied within the scope of the following claims.

What is claimed is:

1. An automatic document handler control system for use on a reproduction machine having an exposure station whereat the documents to be copied are exposed by a suitable light source comprising;

exposure sensing means adapted to provide a control signal in response to each exposure illumination, and means, responsive to said signal, for controlling the operation of the automatic document handler.

2. A control system according to claim 1 wherein said signal responsive means includes a cycle out timer adjustable to a time period slightly longer than the normal time period between successive exposures of the reproduction machine when the machine is making multiple copies of a document, said timer being adapted upon cycle out, to provide a signal to activate the document handler to feed another document to the exposure platen and to indirectly activate the reproduction machine to copy another document, the control signal from said exposure sensing means causing said timer to be reset before said timer cycles out, thereby preventing activation of the document handler to allow production of multiple copies of the document on the exposure platen.

3. A control system according to claim 2, wherein said control system further includes a start switch adapted for initial activation of the document handler.

4. An automatic document handler control system according to claim 1 wherein said exposure sensing means comprises a photodetector mounted in the document handler in a position to detect the light from the exposure illumination.

* * * * *